US006378952B1

(12) United States Patent
Moosmann et al.

(10) Patent No.: US 6,378,952 B1
(45) Date of Patent: Apr. 30, 2002

(54) TOOL FOR A COAL CUTTING, MINING OR ROAD CUTTING MACHINE

(75) Inventors: Bernhard Moosmann; Thomas Allgaier, both of Schramberg (DE)

(73) Assignee: Betek Bergbau-und Hartmetalltechnik Karl-Heinz Simon GmbH & Co., KG, Aichhalden (DE)

( * ) Notice: Subject to any disclaimer, the term of this patent is extended or adjusted under 35 U.S.C. 154(b) by 0 days.

(21) Appl. No.: 09/571,641

(22) Filed: May 15, 2000

(30) Foreign Application Priority Data

May 14, 1999 (DE) ..... 199 22 320

(51) Int. Cl.[7] ..... E21C 35/18
(52) U.S. Cl. ..... 299/104; 299/106
(58) Field of Search ..... 299/104, 105, 299/106, 107

(56) References Cited

U.S. PATENT DOCUMENTS 4,818,027 A * 4/1989 Simon ..... 299/92
5,415,462 A * 5/1995 Massa ..... 299/86
6,113,195 A * 9/2000 Mercier ..... 299/104
6,199,956 B1 * 3/2001 Kammerer ..... 299/111

FOREIGN PATENT DOCUMENTS

DE 37 01 905 9/1988
RU 2002050 C1 * 10/1993 ..... E21C/25/38

* cited by examiner

*Primary Examiner*—David Bagnell
*Assistant Examiner*—Daniel P Stephenson
(74) *Attorney, Agent, or Firm*—Pauley Petersen Kinne & Erickson

(57) ABSTRACT

A tool for a coal cutting, mining or road cutting machine, having a round-shaft cutter with a cutter head and a cutter shaft. A wear-protection disk is pushed on the cutter shaft, on an upper side of which the cutter head rests. The cutter shaft is captively held in a receiver of a holding projection of a cutter holder in a direction of a center longitudinal axis of the projection but freely rotatable around the center longitudinal axis. The projection has a support surface which extends at least in sections around the receiver on which a wear-protection disk rests with an opposite surface and is supported on a support surface of the cutter holder. The cutter head rests on the upper side of the wear-protection element facing away from the support surface. In order to better protect the cutter holder of such a tool against wear effects, the support surface extends transversely with respect to the center longitudinal axis of the receiver up to exterior dimensional limits of the area of the holding projection adjoining the support surface. The wear-protection disk covers the entire, radially outwardly located area of the support surface with its opposite face.

10 Claims, 1 Drawing Sheet

TOOL FOR A COAL CUTTING, MINING OR ROAD CUTTING MACHINE

BACKGROUND OF THE INVENTION

1. Field of the Invention

This invention relates to a tool for a coal cutting, mining or road cutting machine, having a round-shaft cutter with a cutter head and a cutter shaft, wherein a wear-protection disk is pushed on the cutter shaft, on an upper side of which the cutter head rests, wherein the cutter shaft is held captively in a receiver of a holding projection of a cutter holder in a direction of a center longitudinal axis of the projection but freely rotatable around the center longitudinal axis, and wherein the projection has a support surface, which extends at least in sections around the receiver, on which the wear-protection disk rests with an opposite surface and is supported on a support surface of the cutter holder, and wherein the cutter head rests on the upper side of the wear-protection disk facing away from the support surface.

2. Description of the Related Art

A conventional tool is known from German Letters Patent 37 01 905.809. A round-shaft cutter is rotatably seated in the receiver, embodied as a bore, of the cutter holder. The wear-protection disk is arranged between the cutter head and the support surface. During operation, the cutter head slides on the surface of the wear-protection disk because of the rotating movement of the round-shaft cutter. The wear-protection disk also rotates because of the frictional forces and slides on the support surface of the tool holder. Thus, wear of the wear-protection disk, as well as of the cutter holder, is generated. Because of the wear of the cutter holder, the wear-protection disk works its way into the support surface of the cutter holder. The area of the cutter holder adjoining the support surface is then subjected to considerable wear.

SUMMARY OF THE INVENTION

It is one object of this invention to provide a tool of the type previously mentioned, wherein the cutter holder is better protected against wear.

According to this invention, this object is attained with a support surface that extends transversely with respect to the center longitudinal axis of the receiver up to the exterior dimensional limits of an area of the holding projection adjoining the support surface. The wear-protection disk covers the entire, radially outwardly located area of the support surface with its opposite face.

As a result of the support surface of the wear-protecting disk, which is increased in comparison to conventional tools, the friction surface between the wear-protecting disk and the cutter holder is also increased. With this, the effective frictional forces are also increased, so that the inclination of the wear-protection disk to rotate on the cutter holder is reduced. This then results in a reduced wear of the cutter holder. Because the wear-protection disk extends up to the dimensional limits of the area adjoining the support surface, the wear-protection disk is prevented from working itself into the support surface. A dependable protection of the cutter holder thus results.

In one preferred embodiment of this invention, the holding projection is laterally formed on a base body of the cutter holder. When viewed in the direction of the center longitudinal axis of the receiver, the holding projection protrudes past the cutter holder. The support surface is arranged on the free end of the protrusion. The protrusion forms an area which adjoins the support surface, up to whose dimensional limits the wear-protection disk extends.

Thus, the protrusion of the holder projection is circularly embodied, and the support surface has a ring-shaped form.

So that the cutter holder is not worn to an overly large degree, in one embodiment of this invention the holding projection has one or several wear markings, which are arranged in the area behind the wear-protection disk. The wear markings can also be electrical detection units, which emit an electrical signal when the wear limit is reached.

However, it is also possible that indentations are cut into the protrusion of the holding projection, which extend on the circumference around the center longitudinal axis of the receivers and are used as wear markers, so that visual wear can be detected.

The material of the wear-protection disk can be of lesser hardness than the cutter head and the holding projection of the cutter holder.

In order to dependably dissipate the forces generated while cutting a road surface, the support surface has a diameter of more than 38 mm, preferably 44 mm.

DESCRIPTION OF THE DRAWINGS

This invention will be explained in greater detail in the specification by an exemplary embodiment represented in the drawings, wherein.

DESCRIPTION OF PREFERRED EMBODIMENTS

Figure 1:
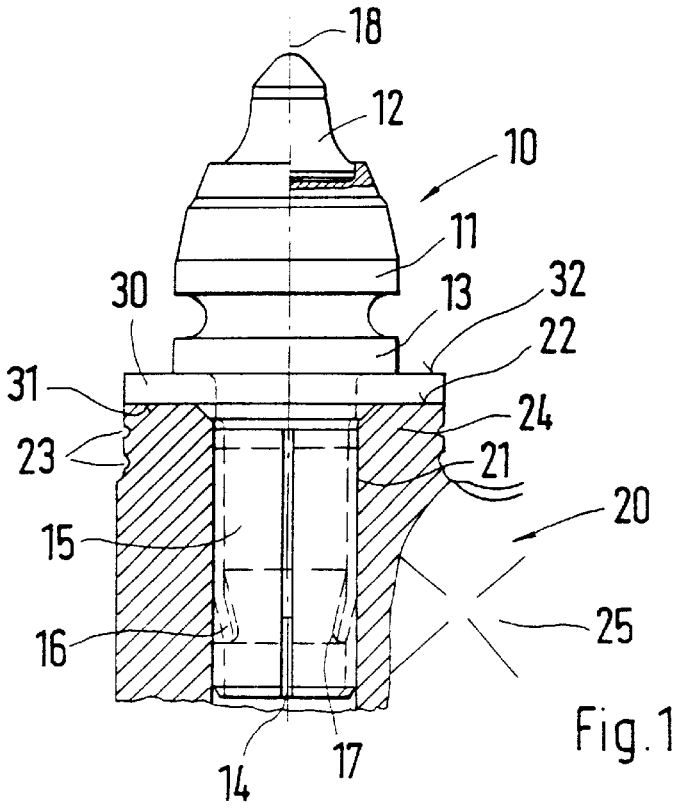
FIG. 1 is a partial sectional side view of a tool holder with a round-shaft cutter fastened thereon.
Figure 2:
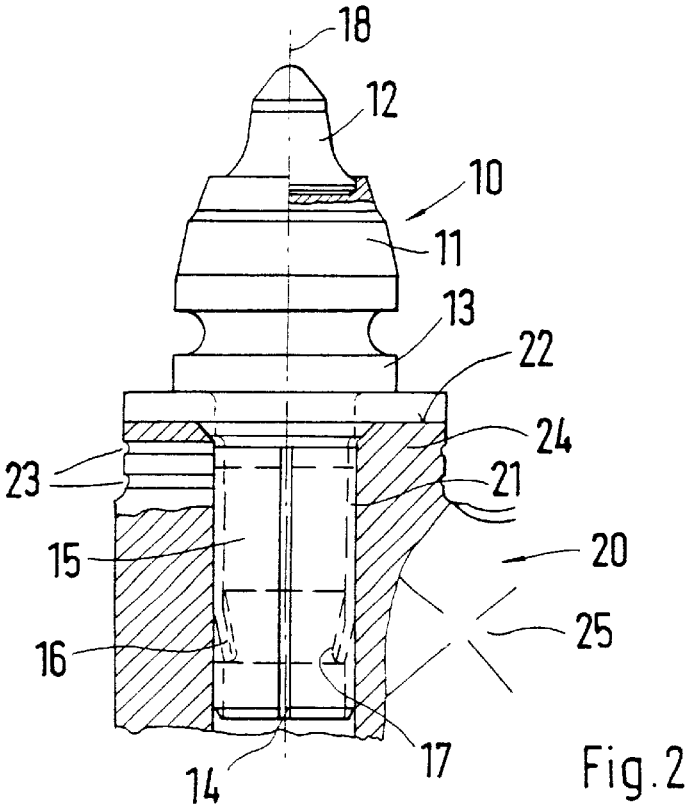
FIG. 2 is a partial sectional view of a tool holder according to FIG. 1, but in a different sectional view than the view shown in FIG. 1.

A tool, having a round-shaft cutter 10 and a cutter holder 20, is shown in the drawings. The cutter holder 20 has a base body 25, on which a holding projection 24 is laterally formed. A receiver 21, embodied as a bore, is cut into the holding projection 24. At its upwardly facing bore inlet, the receiver 21 transitions via an insertion section into the radially extending support surface 22. The support surface 22 extends vertically with respect to the center longitudinal axis 18 of the receiver 21 and extends in a ring shape around it. The support surface 22 is a part of a protrusion of the holding projection 24. The protrusion is cylindrically embodied. The support surface 22 extends up to the radially outside-located dimensional limits of the protrusion.

Two wear markings 23, which are arranged one behind the other, are cut into the protrusion below the support surface 22. The wear markings 23 are designed as circumferential grooves. These grooves are preferably of a V-shaped cross-sectional geometry.

A round-shaft cutter 10 can be fastened on the cutter holder 20. The round-shaft cutter 10 has a cutter head 11 and a cutter shaft 14 formed on the round-shaft cutter 10. The cutter head 11 has a receiver for a cutter tip 12 on its end facing away from the cutter shaft 14. The cutter tip 12, which is made of a hard alloy, is soldered into the receiver. In the transition area to the cutter shaft 14, the cutter head 11 has a collar 13. In the area of its free end, the cutter shaft 14 has a circumferential groove 17. Holding elements 16 of a clamping sleeve 15 enter into the circumferential groove 17. The clamping sleeve 15 encloses the cutter shaft 14 and has a longitudinally directed opening slit. The holding elements 16 are punched out of the clamping sleeve surface and are bent in a direction toward the groove 17. The exterior surface of the clamping sleeve 15 is spring-elastically clamped together with the interior surface of the receiver 21. By means of the clamping sleeve 15, the round-shaft cutter 10 is seated axially captive but freely rotatable around the center longitudinal axis 18 of the receiver 21.

A wear-protection disk 30 is arranged between the cutter head 11 and the cutter shaft 14. The wear-protection disk 30 has a central opening through which the cutter shaft 14 passes. The cutter head 11 is supported by its collar 13 on the surface 32 of the wear-protection disk 30. The wear-protection disk 30 is placed on the support surface 22 of the cutter holder with its underside facing away from the collar 13. As shown in the drawings , the wear-protection disk 30 extends over the entire support surface 22.

During operation of the tool, the round-shaft cutter 10 rotates in the receiver 21 of the cutter holder 20. The cutter head 11 also slides over the top of the wear-protection disk 30 during operation. Simultaneously, the wear-protective disk 30 moves relative to the support surface 22. Wear occurs on the top 32 of the wear-protection disk 30 as a result of the movement of the round-shaft cutter 10. The support surface 22 is worn because of the rotation of the wear-protection disk 30. Because the wear-protection disk 30 extends as far as the edges of the protrusion of the holding projection 24, the protrusion wears evenly. The degree of wear can be ascertained from the wear markings 23.

What is claimed is:

1. In a tool for at least one of a coal cutting machine, a mining machine and a road cutting machine, having a round-shaft cutter with a cutter head and a cutter shaft, wherein a wear-protection disk is pushed on the cutter shaft on an upper side of which the cutter head rests, wherein the cutter shaft is captively held in a receiver of a holding projection of a cutter holder in a direction of a center longitudinal axis of the projection but freely rotatable around the center longitudinal axis, wherein the projection has a first support surface which extends at least in sections around the receiver, and on which a wear-protection disk rests with an opposite surface and is supported on a second support surface of the cutter holder, and wherein the cutter head rests on the upper side of the wear-protection disk facing away from the support surface, the improvement comprising:

the support surface (22) extending transversely with respect to the center longitudinal axis (18) of the receiver (21) up to an exterior dimensional limit of an area of the holding projection (24) adjoining the support surface (22);

the wear-protection disk (30) covering an entire radially outwardly located area of the support surface (22) with an opposite face (31) of the wear-protection disk (30); and the holding projection (24) having at least one wear marking arranged behind the wear-protection disk (30).

2. The tool in accordance with claim 1, wherein the holding projection (24) is laterally formed on a base body (25) of the cutter holder (20), when viewed in the direction of the center longitudinal axis (18) of the receiver (21), the holding projection (24) protrudes past the cutter holder (20), and the support surface (22) is arranged on a free end of the protrusion.

3. The tool in accordance with claim 2, wherein the protrusion of the holder projection (24) is circularly embodied, and the support surface (22) has a ring-shaped form.

4. The tool in accordance with claim 3, wherein the holding projection (24) has at least one wear marking arranged behind the wear-protection disk (30).

5. The tool in accordance with claim 4, wherein a plurality of indentations cut into the protrusion of the holding projection (24) extend circumferentially around the center longitudinal axis (18) of the receiver (21).

6. The tool in accordance with claim 5, wherein a material of the wear-protection disk (30) is of lesser hardness than the cutter head (11) and the holding projection (24) of the cutter holder (20).

7. The tool in accordance with claim 6, wherein the support surface (22) has a diameter of more than 38 mm.

8. The tool in accordance with claim 1, wherein a material of the wear-protection disk (30) is of lesser hardness than the cutter head (11) and the holding projection (24) of the cutter holder (20).

9. The tool in accordance with claim 1, wherein the support surface (22) has a diameter of more than 38 mm.

10. In a tool for at least one of a coal cutting machine, a mining machine and a road cutting machine, having a round-shaft cutter with a cutter head and a cutter shaft, wherein a wear-protection disk is pushed on the cutter shaft on an upper side of which the cutter head rests, wherein the cutter shaft is captively held in a receiver of a holding projection of a cutter holder in a direction of a center longitudinal axis of the projection but freely rotatable around the center longitudinal axis, wherein the projection has a first support surface which extends at least in sections around the receiver, and on which a wear-protection disk rests with an opposite surface and is supported on a second support surface of the cutter holder, and wherein the cutter head rests on the upper side of the wear-protection disk facing away from the support surface, the improvement comprising:

the support surface (22) extending transversely with respect to the center longitudinal axis (18) of the receiver (21) up to an exterior dimensional limit of an area of the holding projection (24) adjoining the support surface (22);

the wear-protection disk (30) covering an entire radially outwardly located area of the support surface (22) with an opposite face (31) of the wear-protection disk (30); and the holding projection (24) laterally formed on a base body (25) of the cutter holder (20), when viewed in the direction of the center longitudinal axis (18) of the receiver (21), the holding projection (24) protruding past the cutter holder (20), and the support surface (22) arranged on a free end of the protrusion; and a plurality of indentations cut into the protrusion of the holding projection (24) extending circumferentially around the center longitudinal axis (18) of the receiver (21).

* * * * *